United States Patent [19]

Peterson

[11] 4,222,334

[45] Sep. 16, 1980

[54] HOPPER DISCHARGE DOOR OPERATING MECHANISM

[75] Inventor: William H. Peterson, Homewood, Ill.

[73] Assignee: Pullman Incorporated, Chicago, Ill.

[21] Appl. No.: 24,338

[22] Filed: Mar. 27, 1979

[51] Int. Cl.[2] ..... B61D 7/02; B61D 7/18; B61D 7/26

[52] U.S. Cl. ..... 105/250

[58] Field of Search ..... 105/240, 250, 251, 253, 105/244, 249, 293, 294–299

[56] References Cited

U.S. PATENT DOCUMENTS

| | | | |
|---|---|---|---|
| 1,294,051 | 2/1919 | Clark | 105/250 |
| 1,421,439 | 7/1922 | Finckh | 105/250 |
| 3,314,558 | 4/1967 | Dorey | 105/250 |
| 3,339,500 | 9/1967 | Dorey | 105/253 |
| 3,385,231 | 5/1978 | Dorey | 105/250 |
| 3,452,886 | 7/1969 | Dorey | 105/250 |
| 3,633,515 | 1/1972 | Shaver et al. | 105/240 |
| 3,650,221 | 3/1972 | Nagy | 105/240 |
| 3,717,109 | 2/1973 | Miller | 105/284 |

*Primary Examiner*—Richard A. Bertsch

*Attorney, Agent, or Firm*—Richard J. Myers; Stephen D. Geimer

[57] ABSTRACT

An operating mechanism for sequentially opening and closing hopper discharge door is provided. Longitudinally extending gates are arranged in pairs and are suspended from the hopper by hinge links at one end and by an operator arm located near the center of each gate. A hopper-mounted rotating link is attached to one operator arm and a hopper-mounted bell crank is attached to the other operator arm; both the rotating link and the bell crank are interconnected to sequentially operate the doors. A power cylinder and linkage are connected with the bell crank for automatically opening and closing the doors.

6 Claims, 4 Drawing Figures

HOPPER DISCHARGE DOOR OPERATING MECHANISM

BACKGROUND OF THE INVENTION

1. Field of the Invention

This invention pertains to a gate-operating mechanism for hoppers and specifically to a mechanism used for discharging a lading from railway hopper cars having longitudinally extending pairs of cooperating discharge gates in a car constructed without a conventional, through, center sill.

2. Description of the Prior Art

While the prior art has shown a number of gate-operating mechanisms for longitudinally arranged discharge gates, the prior art is uniform in showing discharge gates which are hinged about a fixed hinge point. Examples of this type of arrangement are shown in the Finckh U.S. Pat. No. 1,421,439 (1922) and the Shaver et al U.S. Pat. No. 3,633,515 (1972) which show longitudinally disposed discharge gates which are interconnected with a locking mechanism providing for simultaneously, sequential opening of the gates. These patented arrangements do not, however, allow the discharge gates to open wide enough to clear the rail and thus provide a somewhat limited size opening for lading being discharged from the vehicle. The Finckh mechanism shows a number of lengthy bar members which must undergo extensive compressive loading and thus are subject to buckling and are hence undesirable. Further, the Finckh arrangement provides a very wide range of movement for the operating member as is present with the Shaver et al disclosure. With this arrangement, a short stroke piston can be utilized to completely open and close the doors.

SUMMARY OF THE INVENTION

This invention pertains to a hopper discharge mechanism which interconnects a pair of cooperating discharge gates to sequentially open and close and provide a completely unrestricted discharge opening for rapidly discharging a hopper.

Specifically, discharge gates are mounted at each end on a pair of swinging link members attached to the hopper. A linkage mechanism interconnects operating arms extending from each discharge doors and the mechanism also includes a rotating link attached to one operator arm and a bell crank attached to the other operator arm. A floating link is used to interconnect the rotating link and bell crank to provide cooperative movement of the two doors.

Because of the location and lengths of the linkage members, a short stroke, double acting operating cylinder can be used and connected with the bell crank for quickly and easily opening and closing the discharge doors. The operating cylinder is connected to an operator crank which is in turn connected to an operator link which is attached to the bell crank. Thus, upon actuating the power cylinder, the attached operator crank is rotated, moving the operator link and correspondingly moving the door operating bell crank.

Because of the arrangement of the rotating link, bell crank, and the operator arms attached to each discharge door, a self-supporting, over center locking arrangement provided which tends to maintain the discharge doors in a closed, locked configuration due to the weight of lading contained within the hoppers.

Thus, it is an object of this disclosure to provide a quick acting, reliable operating mechanism for a hopper whereby linkage members interconnect a pair of cooperative discharge doors in a self-locking, sequentially operating configuration.

It is another object of this disclosure to provide a discharge mechanism for a hopper comprising a pair of doors supported on hinge links which allow the doors not only to rotate but also to translate during opening and closing and thus move completely free of the area between the supporting rails to allow lading to quickly discharge from the hoppers.

Another object of this disclosure is to show a discharge door operating mechanism comprising doors having operator arms extending therefrom and cooperatively attached to a rotating link and to a bell crank member which are interconnected for sequential and simultaneous movement.

These and other objects of the disclosure will become apparent to those having ordinary skill in the art with reference to the following description, drawings and claims.

DESCRIPTION OF THE PREFERRED EMBODIMENT

Figure 1:
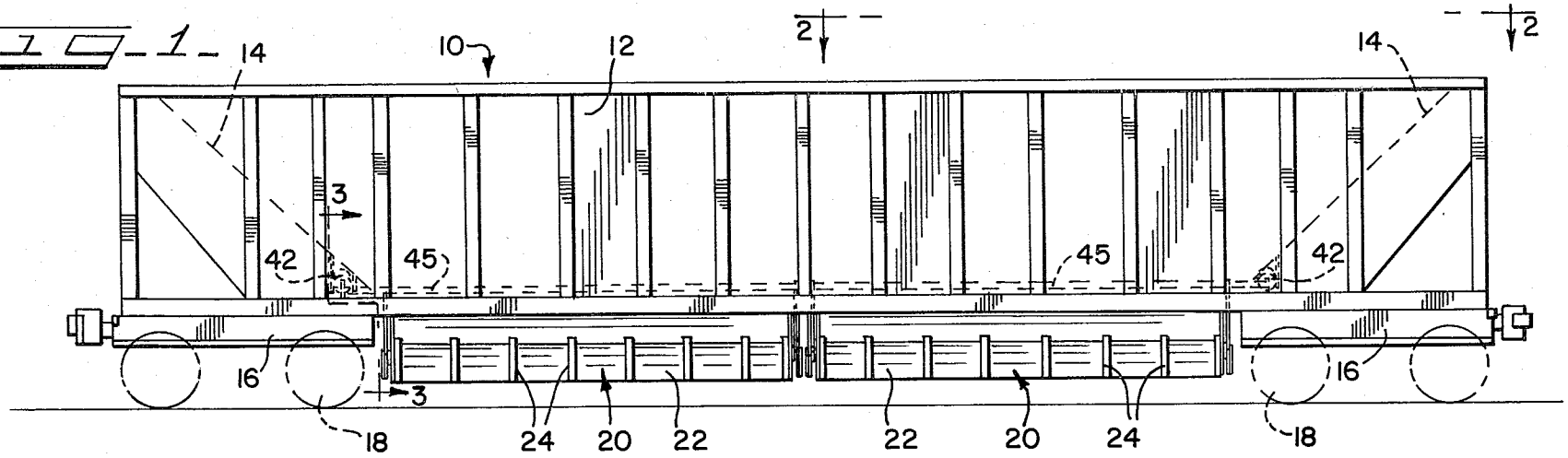
FIG. 1 is a side elevational view of a railway hopper car embodying the discharge door operating mechanism disclosed herein.
Figure 2:
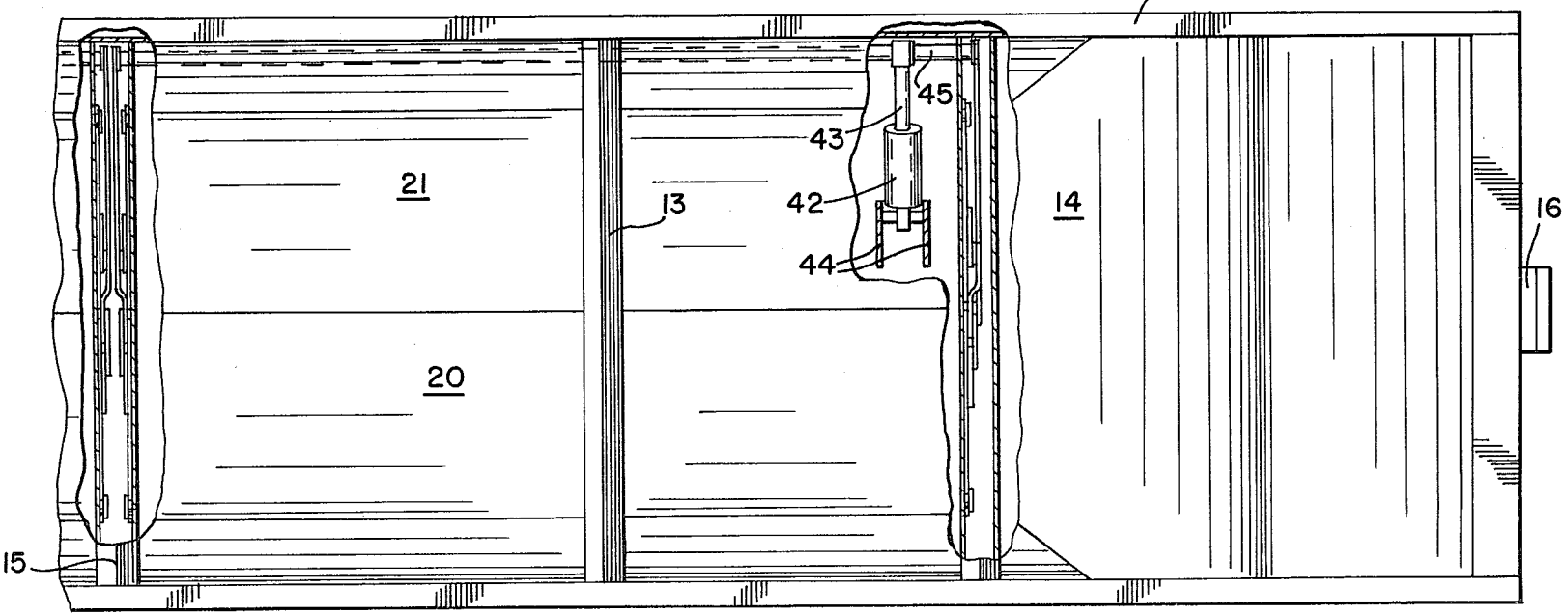
FIG. 2 is an enlarged view taken generally along lines 2—2 of FIG. 1.

Referring now to the drawings and in particular to FIG. 1, there is shown a railway hopper car 10 comprising the usual reinforced sidewall units 12 which may be interconnected by cross bearers 13 to prevent extensive bulging of the sides when the hoppers are filled with lading. As shown in FIGS. 1 and 2, the vehicle includes a pair of large hoppers comprising end slope sheets 14 and an intermediate bulkhead 15. The vehicle is a so-called center sill less car and includes a pair of stub sills 16 located at each end. The usual supporting trucks are shown symbolically at 18.

As shown in the drawings, the hopper car disclosed embodies longitudinally extending openings designed to allow lading to flow between the tracks for quickly and efficiently emptying the car.

Figure 3:
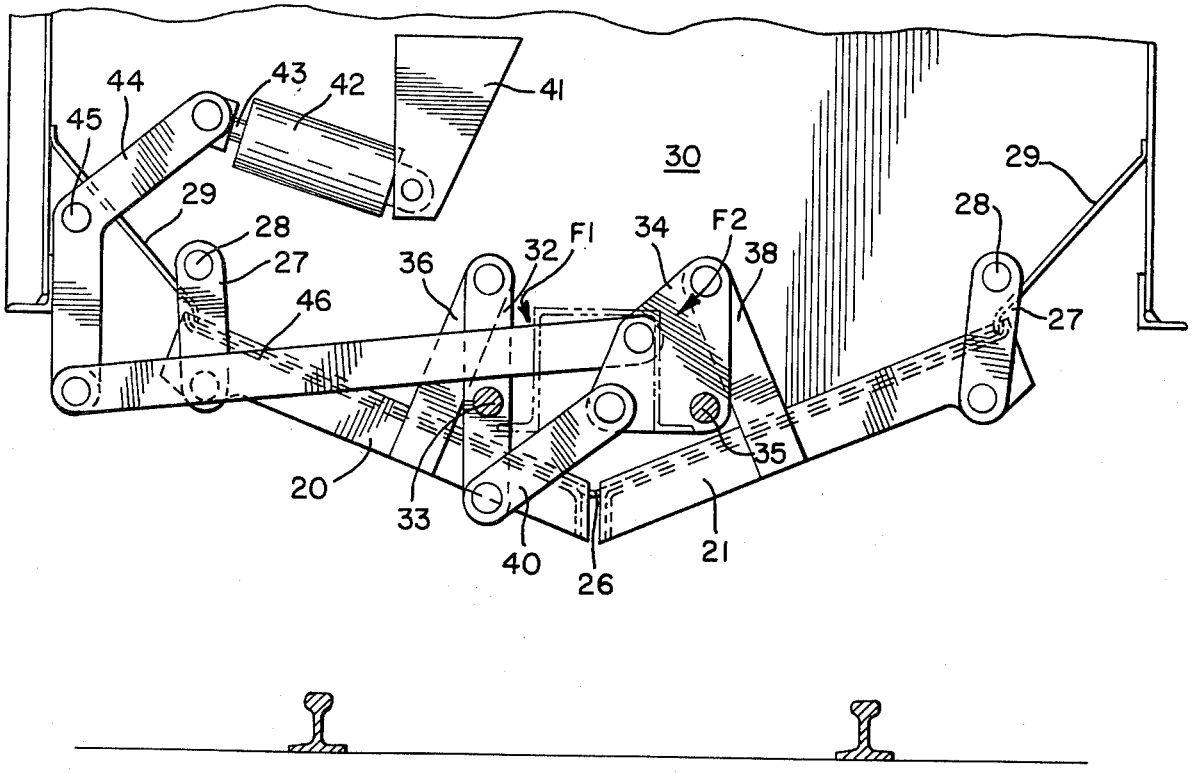
FIG. 3 is an end view of the discharge door operating mechanism showing the mechanism and the doors in a closed position.
Figure 4:
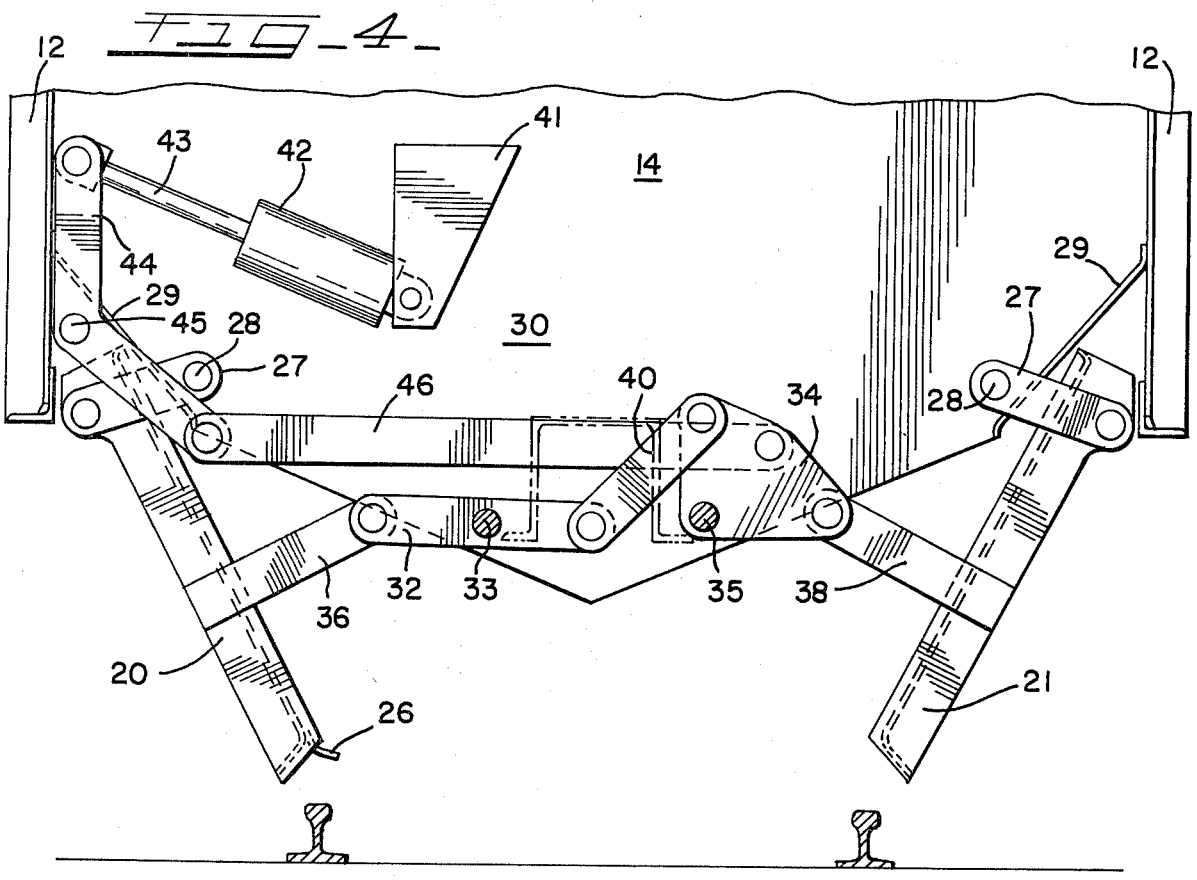
FIG. 4 is a view similar to FIG. 3 showing the operating mechanism and discharge doors in an opened position.

Discharge doors are designated by the numerals 20, 21 designating a first and second door, respectively. As shown in FIGS. 3 and 4, the doors include the usual internal sheet which provides a smooth surface for free-flowing lading. The doors also include a number of transversely extending reinforcing members 24 which rigidify the door and prevent excessive bulging or leaking. When the doors are in a closed position, a lip 26 extends across the seam separating the two doors to provide a seal.

A linkage mechanism is provided for not only supporting the door for hinged-type of pivotal movement, but also providing a number of members which interconnect the door to provide simultaneous, yet sequential, opening and closing which allows the second door 21 to move free of the closing lip 26 before door 20 begins opening movement. Similarly, during closing the reverse is true with the first door 20 closing ahead of door 21. The link members comprise a pair of so-called hinge links which support the doors 20, 21 in a pivotal fashion yet in such a manner as to allow the door to translate, that is move linearly and rotationally from the discharge openings. Links 27 are pivotally attached to the car at 28. Thus, when the doors are in a closed configuration as shown in FIG. 3, the doors are snug against the side slope sheets 29 and against the end sheets 30 to completely seal off the bottom of the hopper.

A rotating link 32 is attached to the hopper end sheet 30 at the so-called link pivot 33. Similarly, a bell crank member 34 is also attached to the end sheet 30 at the pivot designated 35.

Both doors 20, 21 include operator arms 36, 38, respectively, extending upwardly therefrom. The first operator arm 36 is attached to the so-called first door 20 and is pivotally connected at its outer ends to the rotating link 32. In a like fashion, the so-called second operator arm 38 extends from the second door 21 outwardly to a point to where it is connected with the bell crank 34. A floating link 40 is pivotally attached to both the rotating link 32 and the bell crank 34 to interconnect these two members. Thus, with the linkage arrangement described, the doors are interconnected in such a fashion so that movement of one door results in a simultaneous, sequential movement of the other door.

To automatically open and close the doors, a double acting, pneumatic cylinder 42 is provided. It is anticipated that each pair of doors should have at least one cylinder to operate the door pairs. Thus, when the car as shown in FIG. 1, there are two cylinders, one at each end under the end slope sheets 14. A conventional hanger bracket 41 may be used to conveniently mount and securely fasten the cylinder to the vehicle. The usual cylinder rod member is designated at 43. An operator crank 44 is pivotally attached at one end to the piston rod 43 and pivotally attached to the car at 45. Member 45 is an operator shaft which extends the length of the hopper to interconnect each operating mechanism located at each end of the hopper discharge opening. The operator crank 44 transfers the linear, reciprocal movement of the piston rod 43 to the door operating mechanism by means of operator link 46 which interconnects the crank 44 and bell crank 34. When the cylinder is operated, its movement is transferred to the bell crank for moving the various linkage members to open and close the two discharge doors.

Thus, it has been shown by the foregoing that an operating linkage mechanism is provided to operate a pair of discharge doors 20,21 that operate in unison yet sequentially, thus allowing portions of one door to overlap the other door to completely seal off the bottom of the hopper. At the same time the doors are suspended on hinge link members 27 which allow the door to move further from the discharge opening to allow lading to be more quickly discharged from each hopper. Also, when the doors are in a fully closed position (FIG. 3), the door operator arms 38 are so located that the weight of lading within the hopper, which provides a vertical, downward force on the door, provides concurrent forces F1 and F2 acting in the direction of the arrows shown in FIG. 3 which provide an overcenter of self-locking feature to the door mechanism. For example, the force generated at F1 urges the rotating link 32 in a clockwise direction by providing a moment about the link pivot 33 and which also provides a counterclockwise moment to bell crank 34 because of forces transferred through the floating link 40, to the bell crank 34. Forces provided by the floating link 40 to the bell crank 34 tend to rotate the bell crank in a counterclockwise direction insuring that the mechanism remains locked. Similarly, forces of lading which bear upon door 21 provide a force F2 at the end of the operator arm 38 which tends to rotate bell crank 34 in a counterclockwise direction also encouraging the self-locking feature. It is noticed that the mechanism is easily moved from the locked position by counterclockwise rotation of the bell crank 34 which removes the overcenter locking after a relatively small amount of rotation of the bell crank 34 at which time the weight of the lading will then render the doors self-opening.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A door operating mechanism for railway hopper cars having longitudinally disposed discharge openings, the improvement comprising:

first and second discharge doors having inner ends and outer ends and being arranged to move between a closed position with the inner ends adjacent to an open position for material discharge;

hinge link means attached at each outer end and having means connected with the door and with the car for supporting said door;

first and second operator arms extending from said first and second discharge doors;

a rotating link;

said rotating link having pivot means attached to the hopper car spaced from the first door for pivotal, rotational movement of the rotating link;

said rotating link having means pivotally attached to the first operator arm of the first door;

bell crank means;

said bell crank having pivot means attached to the hopper car and spaced above the second door for pivotal, rotational movement of the bell crank;

said bell crank having means operatively attached to the second operator arm extending from the second door;

a floating link;

said floating link having means interconnecting the rotating link and the bell crank for sequential opening and closing of the discharge doors; and means providing a motive force for operating said doors.

2. The door operating mechanism of claim 1, wherein said operating mechanism includes self-locking means comprising:

said first link having a first length extending above the first door when in a closed position and said first length being greater than the distance between the door and the pivot means attaching the rotating link to the car to thereby provide an over center, self-locking feature when the discharge doors are in a closed position.

3. The door operating mechanism of claim 1, wherein said operating mechanism includes self-locking means comprising:

said second link having a second length extending above the second door when in a closed position and said second length providing the connection between the second operator arm and the bell crank at a position above the bell crank pivot means to thereby provide a self-locking, sequentially operating door mechanism.

4. The door operating mechanism of claim 1, wherein said means for operating the discharge door includes double acting, pneumatic power cylinder means; operator link means;

said operator link means having first means attached to the power cylinder means and having second means attached to the bell crank for rotating the bell crank to open and close the discharge doors.

5. The door operating mechanism of claim 4 wherein the power cylinder means includes:

an operator crank with means pivotally attached to the hopper car;

an operator link;

said operator link having means connecting the bell crank and the operator crank.

6. The door operating mechanism of claim 1 wherein said operating mechanism includes self-locking means comprising:

said first link having a first length extending above the first door when in a closed position and said first length being greater than the distance between the door and the pivot means attaching the rotating link to the car to thereby provide an over center, self-locking feature when the discharge doors are in a closed position;

said second link having a second length extending above the second door when in a closed position and said second length providing the connection between the second operator arm and the bell crank at a position above the bell crank pivot means to thereby provide a self-locking, sequentially operating door mechanism.

* * * * *